US006012391A

United States Patent [19]

Weishew

[11] Patent Number: 6,012,391

[45] Date of Patent: Jan. 11, 2000

[54] INK/CLEANING FLUID DELIVERY SYSTEM FOR A CHAMBERED DOCTOR BLADE

[75] Inventor: Joseph John Weishew, Oreland, Pa.

[73] Assignee: The Langston Corporation, Cherry Hill, N.J.

[21] Appl. No.: 09/071,339

[22] Filed: May 1, 1998

Related U.S. Application Data

[60] Provisional application No. 60/044,012, May 2, 1997.

[51] Int. Cl.[7] ..... B41F 35/00

[52] U.S. Cl. ..... 101/424; 101/366

[58] Field of Search ..... 101/424, 425, 101/423, 366, 483, 148; 15/256.5, 256.51, 256.52; 118/259, 24

[56] References Cited

U.S. PATENT DOCUMENTS

| | | | |
|---|---|---|---|
| 3,589,332 | 6/1971 | Dinse | 118/259 |
| 4,181,076 | 1/1980 | Gattus | 101/363 |
| 4,561,377 | 12/1985 | Youngkeit | 118/259 |
| 5,103,732 | 4/1992 | Wells et al. | 118/259 |
| 5,410,961 | 5/1995 | DeNicloa et al. | 101/366 |

*Primary Examiner*—Ren Yan
*Assistant Examiner*—Anthony H. Nguyen
*Attorney, Agent, or Firm*—Seidel, Gonda, Lavorgna & Monaco, PC

[57] ABSTRACT

A fluid delivery apparatus for applying a fluid composition uniformly to the circumferential surface of a rotating transfer roll comprises a fountain having a chamber. A drain is located in a lower portion of the chamber near one end. Doctor blades meter the surface of the anilox roll. A plurality of inlet ports introduce fluid into the chamber. Each inlet port is downwardly angled toward the drain such that fluid flowing through the inlet port displaces fluid in the lower portion of chamber toward the drain end of the chamber.

11 Claims, 5 Drawing Sheets

| FIG.3A | FIG.3B |
|---|---|

INK/CLEANING FLUID DELIVERY SYSTEM FOR A CHAMBERED DOCTOR BLADE

This application claims the benefit of U.S. Provisional Application No. 60/044,012 filed May 2, 1997.

FIELD OF THE INVENTION

The present invention relates to an ink/cleaning fluid delivery system for a chambered doctor blade. The invention finds particular utility in connection with chambered doctor blades having angled inlet nozzles which ensure uniform circulation throughout the ink fountain chamber and greatly improve wash-up efficiency. The present invention is also useful in other contexts where it is desired to maintain a uniform supply of fluid in a chamber. Thus, although the invention is described in a context of a flexographic printing press, the invention is not limited to use in such devices.

BACKGROUND OF THE INVENTION

Flexographic printing is a rotary letter press printing process which traditionally uses flexible rubber, or other elastomer, printing plates and liquid, fast drying ink. The advantage of flexographic printing is its simple ink distribution system.

Referring to FIGS. 1 and 2, in a flexographic printing device 110, a web 100 to be imprinted is passed between an impression cylinder 112 and a plate or print cylinder 114 from which the ink is transferred to the web 100. Ink is applied to the plate cylinder 114 in precisely controlled quantities by a transfer or anilox metering roll 116. The circumferential surface of the anilox roll 116 is divided into a very large number of small cells (typically, 15,000 cells per square centimeter). The surface of the anilox roll 116 is flooded with ink, filling the cells on the roll's surface. Ink is fed to the anilox roll 116 by an ink fountain 118. Typically, the ink fountain 118 extends the entire length of the anilox roll 116 and plate cylinder 114.

A commonly-used ink fountain comprises a reverse angle doctor blade 122*b* which meters the surface of the anilox roll 116 and a second doctor blade 122*a* which forms a sealed ink chamber 120 between the two blades. This system uses the surface tension of the ink itself to load the ink onto the anilox roll 116 so the chamber 120 does not have to be pressurized. Typically, ink is pumped into the base of the chamber 120 through a pair of lower inlets 126. As the ink is pumped into the chamber, the level of the ink within the chamber rises to the level of the overflow outlets 128 where it drains back to the ink supply. Ink flow is maintained by a pump, gravity-return system.

As the anilox roll 116 rotates, the doctor blades 122*a* and 122*b* shave surplus ink from the surface of the anilox roll 116 so that ink is carried only in the interior of the cells of the roll surface and not on the lands between cells. This results in a uniformly-metered film of ink being applied to the surface of the plate cylinder 114.

Standing waves and areas of sluggish flow are common in these conventional chambered doctor blade systems which have only one or two non-angled inlet supply ports and results in less rewetability and chemical uniformity of the ink supplied to the anilox roll.

In addition, the wash-up of the deck (the fountain 118 and anilox roll 116) of conventional chambered doctor blade flexographic presses has been time-consuming and costly. Wash-up is considered to be the biggest part of a job changeover. Whenever the ink is changed in the press (for color, consistency, etc.), the old ink must be removed. In the past, it has been necessary to employ a separate high pressure water source for spray cleaning the anilox roll. Such a cleaning method has the potential to damage the surface of high cell per inch rolls.

The present invention ensures uniform ink circulation throughout the chamber and greatly improves wash-up efficiency by eliminating the need for a separate high pressure water source for spray cleaning the anilox roll.

SUMMARY OF THE INVENTION

A fluid delivery apparatus for applying a fluid composition uniformly to the circumferential surface of a rotating transfer roll comprises a fountain having a chamber. A drain is located in a lower portion of the chamber near one end. Doctor blades meter the surface of the anilox roll. A plurality of inlet ports introduce fluid into the chamber. Each inlet port is downwardly angled toward the drain such that fluid flowing through the inlet port displaces fluid in the lower portion of chamber toward the drain end of the chamber.

The fluid delivery apparatus may include a means for delivering ink and a means for delivering a cleaning fluid to the inlet ports. A manifold may be provided in fluid communication with the inlet ports and the ink delivering means. A nozzle may be disposed in each inlet port for injecting fluid into the chamber. An overflow port may be provided in an upper portion of the chamber for discharging fluid from the chamber.

Additional features and advantages of the invention will become apparent to those skilled in the art upon consideration of the following detailed description of the preferred embodiment as amplifying the best mode of carrying out the invention as presently perceived. The detailed description particularly refers to the accompanying drawings.

BRIEF DESCRIPTION OF THE DRAWINGS

For the purposes of illustrating the invention, there is shown in the drawings a form which is presently preferred; it being understood, however that this invention is not limited to the precise arrangement and instrumentalities shown.

DETAILED DESCRIPTION OF THE PREFERRED EMBODIMENT

Figure 1:
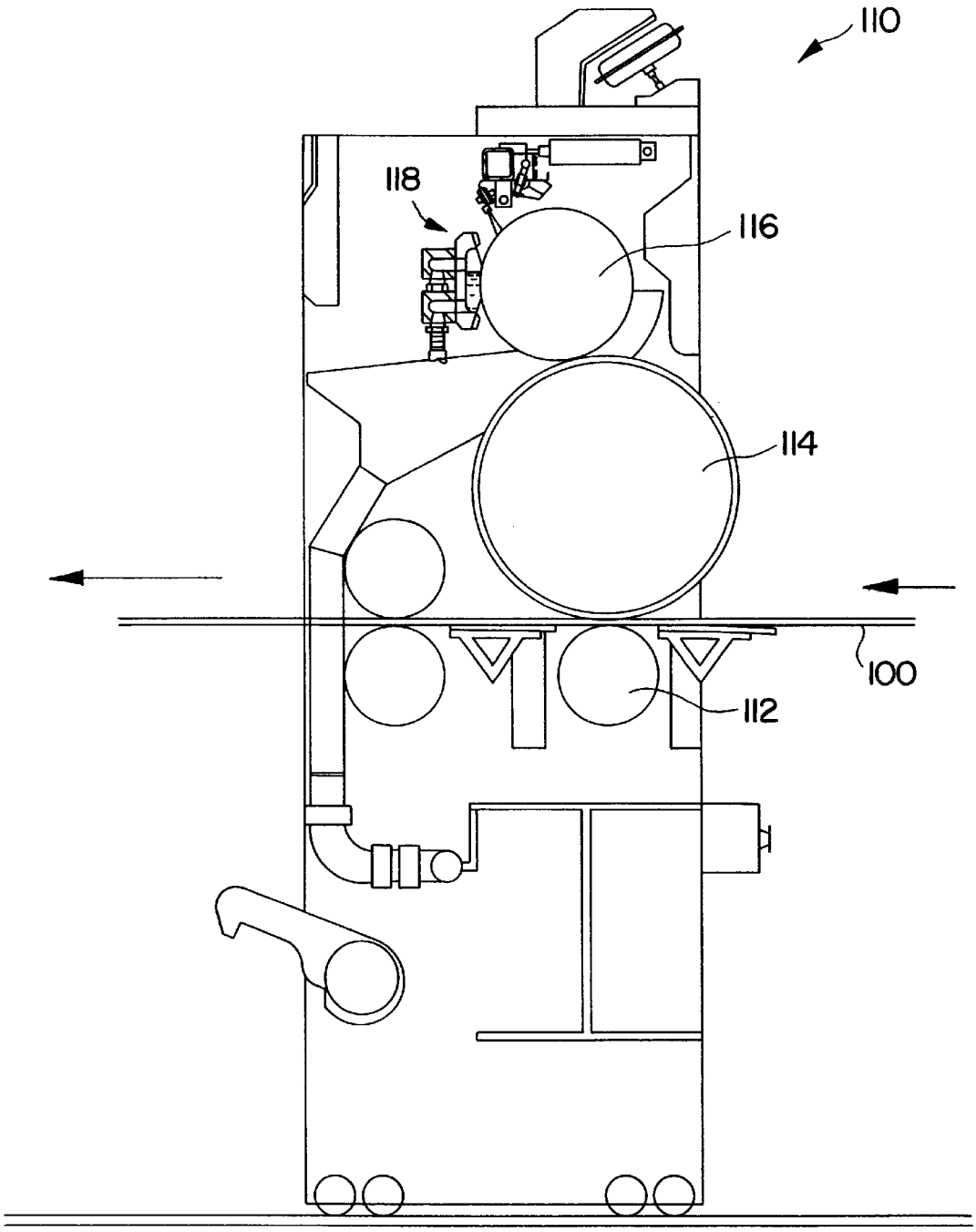
FIG. 1 PRIOR ART
FIG. 1 shows a prior art flexographic printing press having a chamber doctor blade ink fountain.
Figure 2:
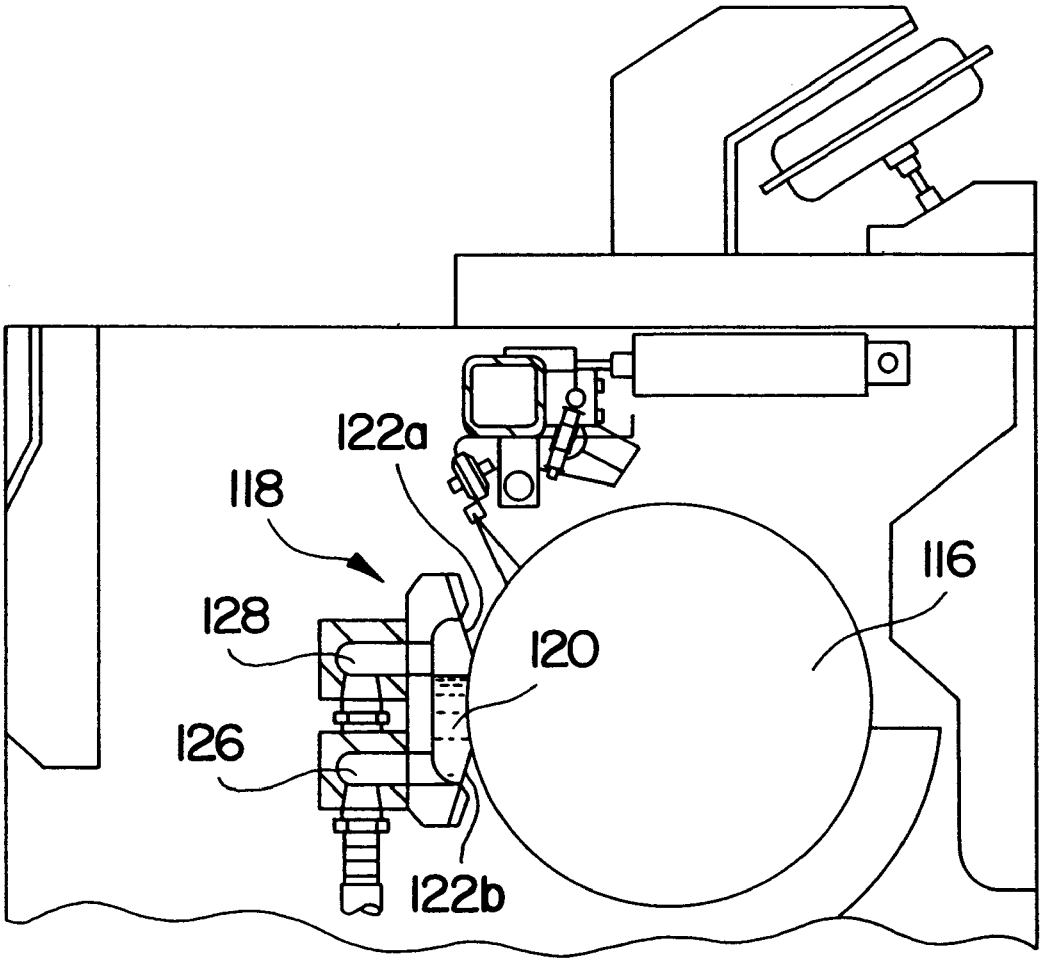
FIG. 2 PRIOR ART
FIG. 2 shows an enlarged partial view of the anilox roll and ink fountain of the prior art device.
Figures 3, 3A:
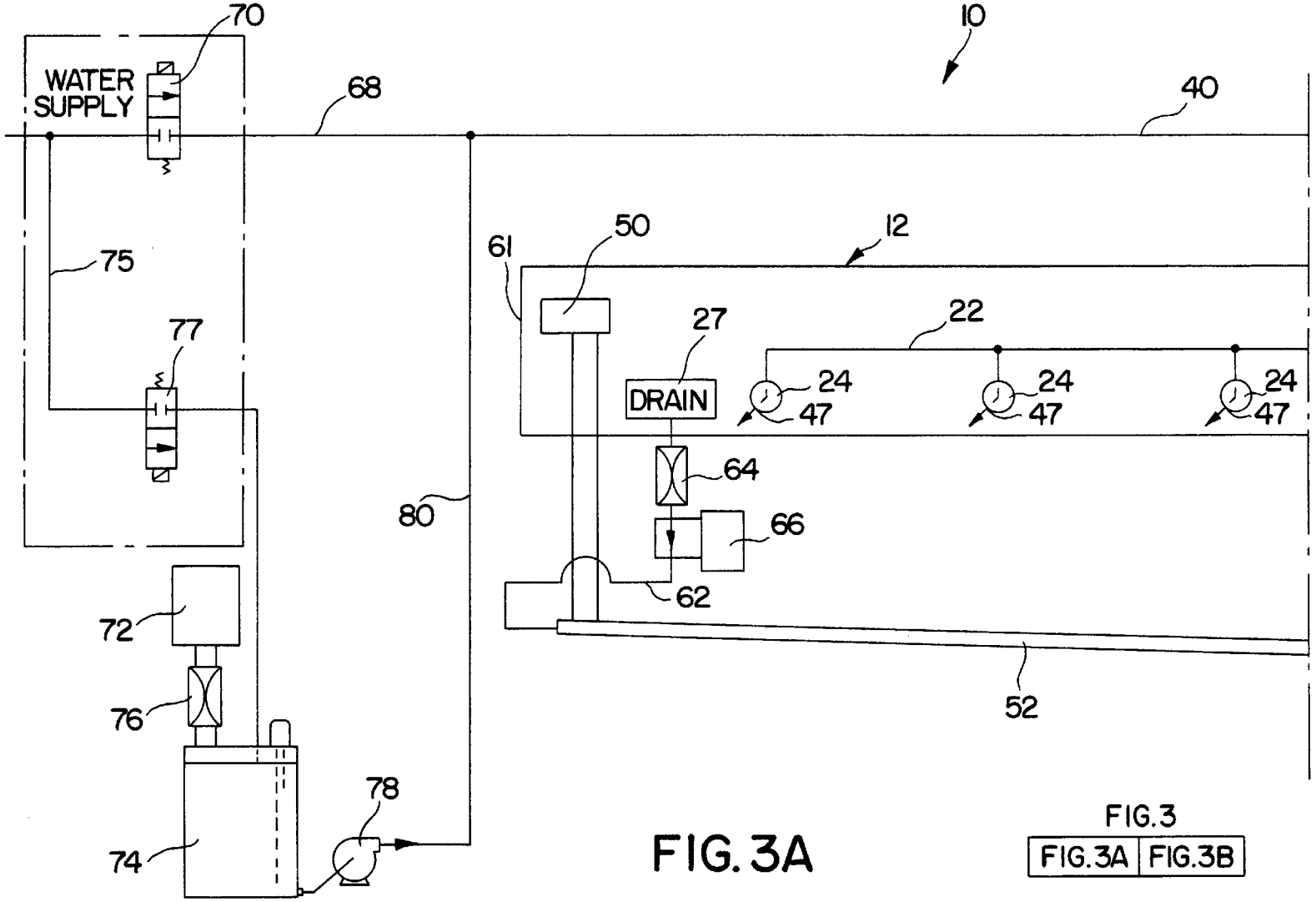
FIGS. 3, 3A, and 3B show, in schematic, an ink/cleaning fluid delivery system for a chambered doctor blade in accordance with one form of the present invention.
Figure 3B:
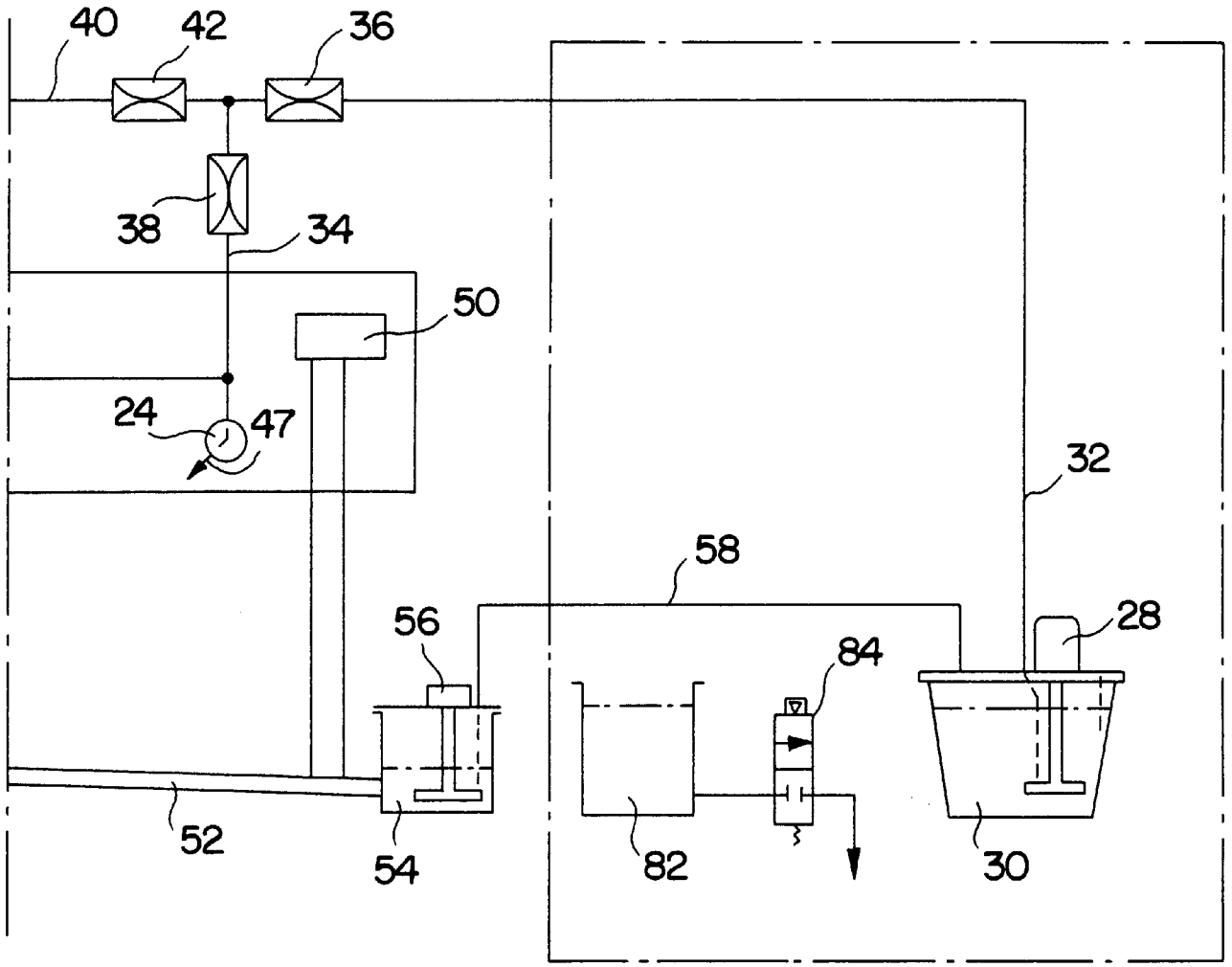
Figure 4:
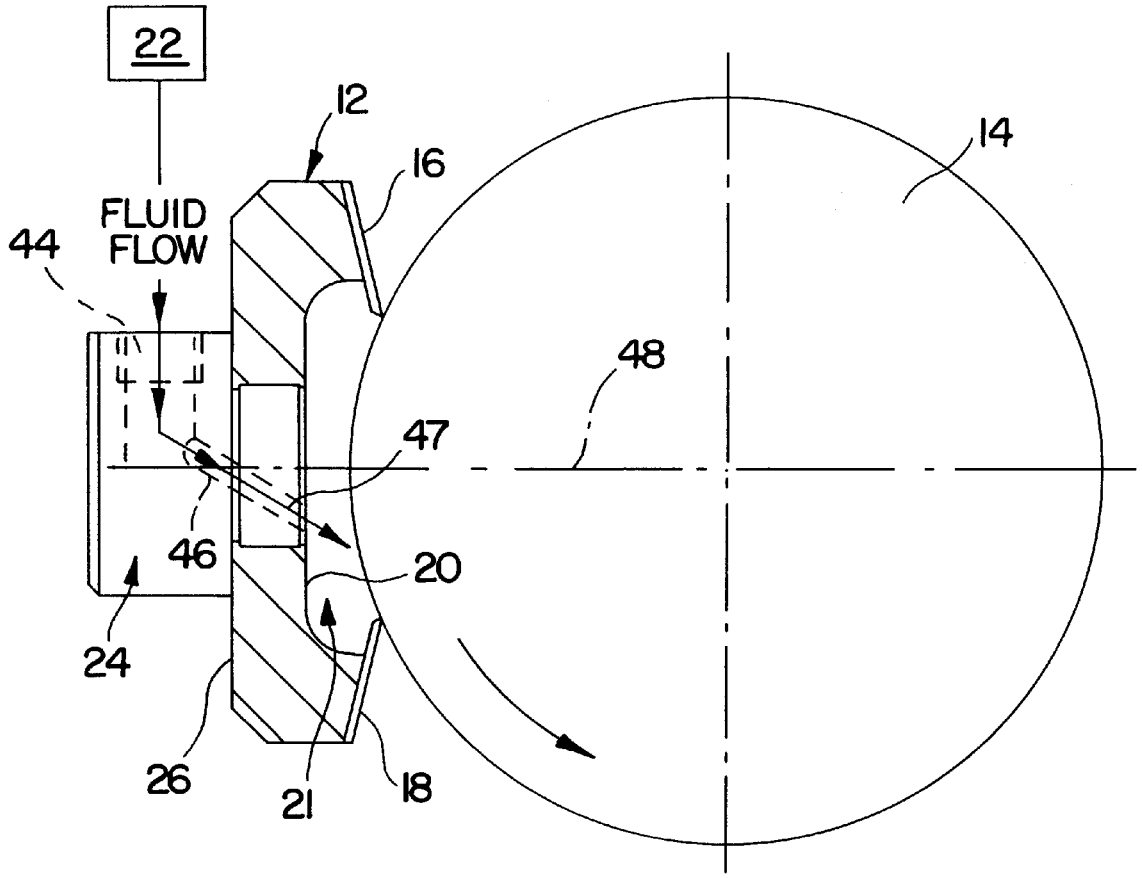
FIG. 4 shows a partial cross-sectional view of the ink fountain and anilox roll of the present invention.

Referring now to the drawings wherein like numerals indicate like elements, FIGS. 3A and 3B illustrate a schematic representation of an ink/cleaning fluid delivery system for a chambered doctor blade 10 in accordance with the present invention. The delivery system 10 includes an ink fountain 12 in sealing engagement with an anilox roll 14 (FIG. 4). Anilox roll 14 has been described and is known in the art, and need not be described in further detail, except to note that, as previously described, anilox roll 14 rotates on its axis relative to the ink fountain 12.

Referring to FIG. 4, ink fountain 12 comprises an upper doctor blade 16 and a lower (or reverse) doctor blade 18. The doctor blades 16 and 18 contact the surface of the anilox roll 14 and meter the ink supplied to the anilox roll 14 by the ink fountain 12. A concave channel 20 is formed along the length of the ink fountain body 12. The surface of the anilox roll 14, the doctor blades 16 and 18 and the channel 20 define a closed chamber or reservoir 21 for containing the ink. A series of spaced inlet nozzles 24 (only one shown in FIG. 4) are provided on the back side 26 of the ink fountain body 12 for injecting ink into the chamber 21 via a plurality of inlet ports 47 which extend through the fountain body 12. A normally-closed drain 27 is provided in a lower portion of the ink fountain body 12 in proximity to one end of the chamber 21 for discharging fluid from the chamber.

Referring to FIGS. 3A and 3B, an ink delivery system is provided for transferring ink to the fountain chamber 21. Ink is pumped by means of a pump 28 from an ink supply, such as a pail 30. The ink travels through ink supply conduit 32 and through chamber supply conduit 34 into an external supply manifold 22 which is connected to the inlet nozzles 24.

An ink supply pinch valve 36 located in the ink supply conduit 32 regulates the flow of ink through the ink supply conduit 32. Similarly, a chamber supply pinch valve 38 controls the flow of ink through the chamber supply conduit 34.

A cleaning fluid delivery system is provided for injecting cleaning fluid into the chamber 21. The cleaning fluid delivery system includes a cleaning fluid supply conduit 40 fluidly connected to the ink supply conduit 32 and the chamber supply conduit 34 for transmitting a cleaning fluid, such as water and detergent solution, to the external manifold 22. An auto wash pinch valve 42 controls the flow of cleaning fluid through the supply conduit 40. When pinch valves 36 and 38 are opened and pinch valve 42 is closed, ink is supplied from the pail 30, by the pump 28, to the manifold 22 and into the chamber 21 via the nozzles 24.

As seen in FIG. 4, the inlet 44 of each nozzle 24 is in fluid communication with the manifold 22. The outlet 46 of each nozzle 24 is in fluid communication with a respective inlet port 47 of the fountain body 12 (as best seen in FIG. 3). The inlet ports 47 are spaced along the length of the fountain body 12 and extend through the back side 26 of the fountain body into the chamber 21.

Each inlet port 47 is disposed at a fixed compound angle with respect to the fountain body 12 such that fluid flowing through the inlet ports displaces fluid in the lower portion of the chamber toward the drain. The inlet ports 47 are disposed at a downward angle in the general direction of the metering doctor blade 18. As best seen in FIG. 3, the inlet ports 47 are also angled toward the end 61 of the chamber in which the drain 27 is disposed to displace fluid in the lower portion of the chamber toward the drain 27. The directional flow of the angled inlet ports 47 eliminates standing waves and areas of sluggish flow which are common in chambered doctor blade systems having only one or two non-angled inlet ports. The direction flow also produces a bottom current which allows high viscosity ink to be circulated through the chamber 21 without stagnating in the end corners of the chamber, greatly improving the rewetability and chemical uniformity of the ink supplied to the anilox roll 14.

As ink is supplied to the chamber 21 via the inlet ports 47, the ink level within the chamber rises until it reaches overflow ports 50 located in the upper corners of the ink fountain body 12. The overflow ports 50 are fluidly connected to a return reservoir 54 via a return conduit 52. Ink flows by gravity out of the chamber 21 via the overflow ports 50 to the reservoir 54. A return pump 56 pumps the ink through a recirculation conduit 58 back to the supply pail 30, where it can be pumped back into the chamber 21. In this way, the level of ink within the chamber 21 is maintained constant as ink is metered.

A drain pipe 62 connects the drain 27 to the return conduit 52. The drain 27 is utilized to evacuate ink from the chamber 21 at the beginning of an ink changeover or wash-up cycle. A drain pinch valve 64 located in the drain pipe 62 controls the flow of fluid therethrough. A drain pump 66 located in the drain pipe 62 pumps the fluid from the drain 27 to the return reservoir 54.

The drain configuration can also be used to maintain a fresh supply of ink in the chamber 21. At regular intervals of time, the drain pinch valve 64 is opened and the drain pump 66 is turned on. Ink is pumped from the bottom of the chamber 21 through the drain 27 and back to the ink supply 30. After a preset time interval, the drain pinch valve 64 is returned to the closed position and the drain pump 66 is turned off. This intermittent "scavenger pump cycle" further enhances the movement of ink along the bottom of the chamber 21 and maintains a fresh ink supply within the chamber 21.

It should be understood that instead of having a single drain located at one end of the chamber, a pair of drains may be located at the ends of the chamber. With such a configuration, it would be advantageous to angle each inlet port toward the closest drain.

During a wash cycle, cleaning fluid is pumped through the system to remove the old ink in the chamber 21. Water is supplied to the chamber 21 from an external source of water via a water line 68 fluidly connected to the cleaning fluid supply conduit 40. A water supply valve 70 located in the water line 68 regulates the flow of water therethrough.

Detergent from a concentrated detergent supply tank 72 is fed to a detergent holder, such as a pail 74 via a metering valve 76. In the detergent pail 74, the detergent is mixed with water which is supplied through a water supply conduit 75 and water valve 77. The detergent mixture is then pumped via a detergent pump 78 through a detergent supply conduit 80 connected to the water and cleaning fluid supply conduit 40 into the chamber 21 of the ink fountain body 12.

During an automatic wash cycle, the drain pump 66 empties ink from the chamber 21 to the ink pail 30. While the ink is draining, the ink supply pump 28 is automatically placed into a wash enclosure 82 which contains a cleaning fluid, such as a water and detergent solution.

At the initiation of the wash cycle the ink supply pinch valve 36 is closed and the auto wash pinched valve 42 is opened. Water is supplied from water supply through the external manifold 22 and into the chamber 21 via the nozzles 24. The detergent pump 78 also adds the detergent solution from the pail 74 into the chamber 21. The pressure of the water and the detergent solution is controlled by the valve 70 and the pump 78 such that the cleaning solution is injected through the nozzles 24 like a fountain, and not as a spray.

Since the nozzles 24 are angled toward the drain 27, fluid flowing through the nozzles forces the fluid within the chamber toward the drain 27 for evacuation. The cleaning fluid entering the chamber 21 through the nozzles 24 also creates turbulence within the chamber 21. This turbulence ensures an efficient cleaning action on the anilox roll 14 surface and eliminates the need for a separate high pressure water source to spray clean the anilox roll 14.

Upon the completion of the cleaning cycle, the cleaning fluid is completely drained from the chamber 21 through the drain 27 by the drain pump 66. The ink supply pump 28 is removed from the wash enclosure 82 and returned to the ink supply pail 30. The cleaning fluid within the wash enclosure 82 is then drained via a drain valve 84 and refilled with fresh cleaning fluid to complete the cycle.

The present invention may be involved in other specific forms without departing from the spirit or essential attributes thereof and, accordingly, reference should be made to the appended claims, rather than to the foregoing specification, as indicating the scope of the invention.

What is claimed is:

1. A fluid delivery apparatus for uniformly applying a fluid to the circumferential surface of a rotating transfer roll comprising:

a fountain having a chamber, a drain located in a lower portion of the chamber near one end of the chamber for discharging fluid therefrom, at least one doctor blade for metering the surface of the transfer roll, and a plurality of inlet ports for introducing fluid into the chamber, each inlet port being angled downwardly and angled toward the drain such that fluid flowing through the inlet port displaces fluid in the lower portion of chamber toward the drain end of the chamber.

2. The fluid delivery apparatus according to claim 1, further comprising means for delivering ink to the inlet ports.

3. The fluid delivery apparatus according to claim 2, further comprising means for delivering a cleaning fluid to the inlet ports.

4. The fluid delivery apparatus according to claim 2, further comprising a manifold in fluid communication with the inlet ports and the ink delivering means.

5. The fluid delivery apparatus according to claim 3, further comprising a manifold in fluid communication with the inlet ports, the ink delivering means, and the cleaning fluid delivering means.

6. The fluid delivery apparatus according to claim 1, further comprising a nozzle disposed in each inlet port for injecting fluid into the chamber.

7. The fluid delivery apparatus according to claim 3, further comprising a nozzle disposed in each inlet port for injecting fluid into the chamber.

8. The fluid delivery apparatus according to claim 1, further comprising an overflow port in an upper portion of the chamber for discharging fluid from the chamber.

9. A method for uniformly delivering fluid to a chambered doctor blade comprising the steps of:

providing a fountain having a chamber, a drain located in a lower portion of the chamber near one end of the chamber for discharging fluid therefrom, at least one doctor blade for metering the surface of the transfer roll, and a plurality of inlet ports for introducing fluid into the chamber, each inlet port being angled downwardly and angled toward the drain;

delivering ink to the inlet ports such that fluid flowing through the inlet ports displaces fluid in the lower portion of chamber toward the drain.

10. The method for delivering fluid to a chambered doctor blade according to claim 9, further comprising the step of delivering a cleaning fluid to the inlet ports such that a the cleaning fluid creates turbulence in the chamber.

11. The method for delivering fluid to a chambered doctor blade according to claim 9, further comprising the step of intermittently draining fluid from the chamber via the drain and recirculating it back into the chamber.

* * * * *